United States Patent [19]

Cox et al.

[11] Patent Number: 4,649,656

[45] Date of Patent: Mar. 17, 1987

[54] WET SUIT BOOT

[76] Inventors: Michael D. Cox, 146 La Ventana, Carmel Valley, Calif. 93924; Brad A. Johnson, 443 Lighthouse Ave., Monterey, Calif. 93940; Brad B. Stewart, Rte. 1, Box 78, Carmel, Calif. 93923

[21] Appl. No.: 731,496

[22] Filed: May 7, 1985

[51] Int. Cl.[4] ..... A43B 1/10; A43B 5/00; A43B 11/00

[52] U.S. Cl. ..... 36/4; 36/9 R; 36/50; 36/114; 2/DIG. 6

[58] Field of Search ..... 36/114, 4, 9 R, 10, 36/117, 119, 54, 50, 58.5, 88, 89; 2/DIG.6, 2.1 R, 2.1 A

[56] References Cited

U.S. PATENT DOCUMENTS

| | | | |
|---|---|---|---|
| 3,771,169 | 11/1973 | Edmund | 2/2.1 R |
| 3,977,098 | 8/1976 | Chalmers | 36/89 |
| 4,136,468 | 1/1979 | Munschy . | |
| 4,143,474 | 3/1979 | Blanc | 36/54 |
| 4,276,341 | 6/1981 | Tanaka | 2/2.1 R |
| 4,294,022 | 10/1981 | Stockli et al. . | |
| 4,397,105 | 8/1983 | Richardson | 36/114 X |
| 4,513,520 | 4/1985 | Koch | 36/10 X |
| 4,523,392 | 6/1985 | Gabrielli | 36/10 |

FOREIGN PATENT DOCUMENTS

| | | | |
|---|---|---|---|
| 2454280 | 11/1980 | France | 36/4 |

OTHER PUBLICATIONS

*Velcro Product News,* May 1978, PN No. 45, Velcro USA Inc., 681 Fifth Ave., New York, NY 10022.

*Primary Examiner*—James Kee Chi

*Attorney, Agent, or Firm*—Robert B. Chickering; Glen R. Grunewald

[57] ABSTRACT

A wet suit boot having a foot portion attached to a tongue and an ankle portion in which the ankle portion includes two wrap-around flaps one of which is releasably connectable to the outside of the tongue and the other of which is releasably connectable to the outside of the first flap.

4 Claims, 5 Drawing Figures

WET SUIT BOOT

FIELD OF THE INVENTION

This invention is in the field of wet suit boots.

BACKGROUND OF THE INVENTION

Wet suits worn by surfers, divers, sailboarders and other water sports enthusiasts are normally made of closed cell foam elastomer, which permits water to flow into the wet suit through sleeve, ankle and neck openings but inhibits the circulation of such water due to the tight-fitting nature of the suit. The water that has entered the suit thereby forms a thin, non-circulating film between the body of the diver and the suit. This film of water is heated by the body of the diver and, in effect, forms a layer of thermal insulation. Because the thermal insulating property of the wet suit can only be achieved by inhibiting the circulation of the film of water, the suit must be made to tightly fit the body of the diver.

In particular, achieving a tight fit with boots used in underwater diving and other aquatic activities is extremely difficult because the boot must have an opening large enough to permit insertion of the foot yet fit tightly about the ankle. The patent to Stockli et al., U.S. Pat. No. 4,294,022 is exemplary. The difficulty with slip-on boots of the foregoing type is that if they are constructed tight enough to inhibit water circulation inside the boot, they are very difficult to put on and to take off due to the width of the foot. Additionally, the stretching of the elastomeric material that occurs whenever the slip-on boot is removed or applied can lead to permanent deformation or tearing of the material.

Boots of this character have been constructed with zippers, laces or other fasteners to permit easy application and removal. However, these constructions do not adequately inhibit water circulation inside the boot and consequently, the utility of the boots have been sacrificed in favor of easy application and removal.

SUMMARY OF THE INVENTION

The boot of the present invention retains the thermal insulating property of the elastomeric material while providing for easy application and removal by uniquely constructing the boot with an opening large enough for the foot that is adjustable to a tight fit after the boot has been put on.

The boot of the present invention includes a foot-enclosing portion that tightly fits the foot of the wearer and an ankle-enclosing portion having a central segment attached at the back and ankle of the foot-enclosing portion, a medial flap extending from one side of the segment and a lateral flap extending from the opposite side of the segment to form a closable open front to the boot. The boot further includes a tongue, attached to and extending generally from the foot enclosing portion toward the central segment and first and second fastening means for adjusting the ankle-enclosing portion of the boot tightly about the ankle and lower calf. The first fastening means of the present invention is formed and positioned to overlap and releasably fasten the medial flap of the ankle-enclosing portion to the tongue, and the second fastening means is formed and positioned to overlap and releasably fasten the lateral flap of the ankle-enclosing portion to the medial flap.

The first fastening means is provided by a first pair of mating fastener elements, one of the pair being mounted on the exterior surface of the tongue and the other being mounted on the interior surface of the medial flap. Likewise, the second fastening means is provided by a second pair of mating fastener elements one of the pair being mounted on the exterior surface of the medial flap and the other being mounted on the interior surface of the lateral flap. Preferably, these elements are provided by mating hook and loop fasteners and the ankle enclosing portion, foot enclosing portion and tongue are formed from a flexible, closed-cell foam elastomer.

This construction is capable of opening widely to permit easy application and removal of the boot while in its closed position it insures a tight fit to inhibit the circulation of the water inside the boot. Further features and advantages of the present invention are set forth in the following detailed description and accompanying drawings.

DETAILED DESCRIPTION OF THE INVENTION

Figure 1:
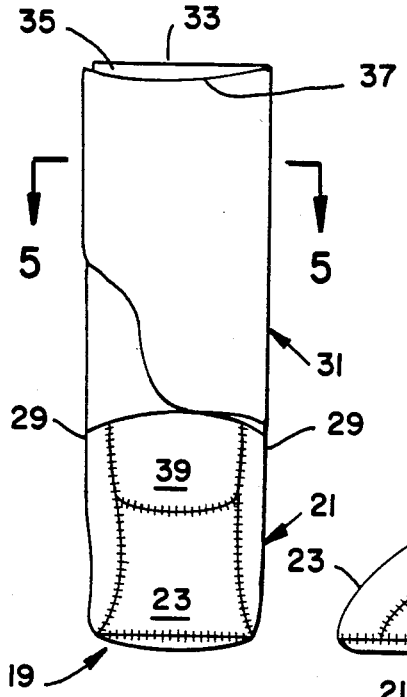
FIG. 1 is a front elevation view of a wet suit boot embodying the present invention.
Figure 3:
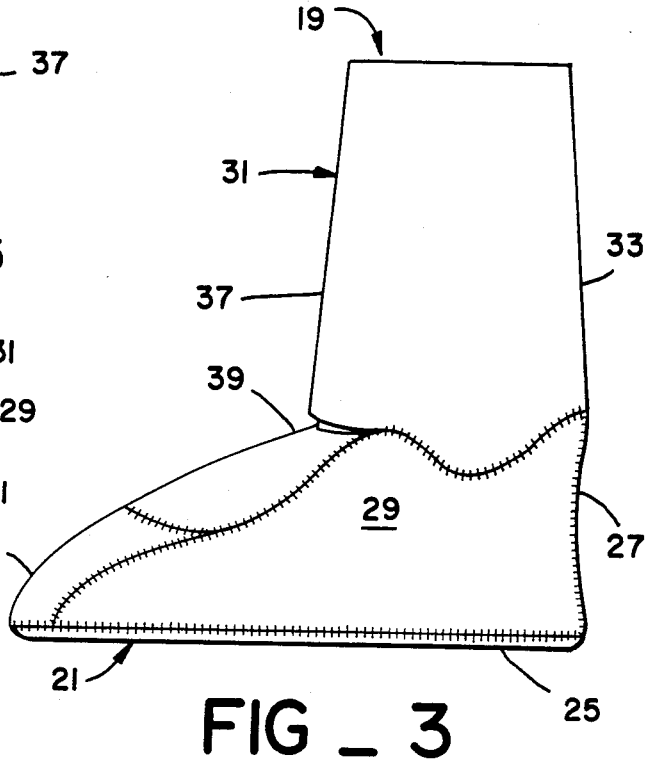
FIG. 3 is a side elevation view of one side of the boot.
Figure 2:
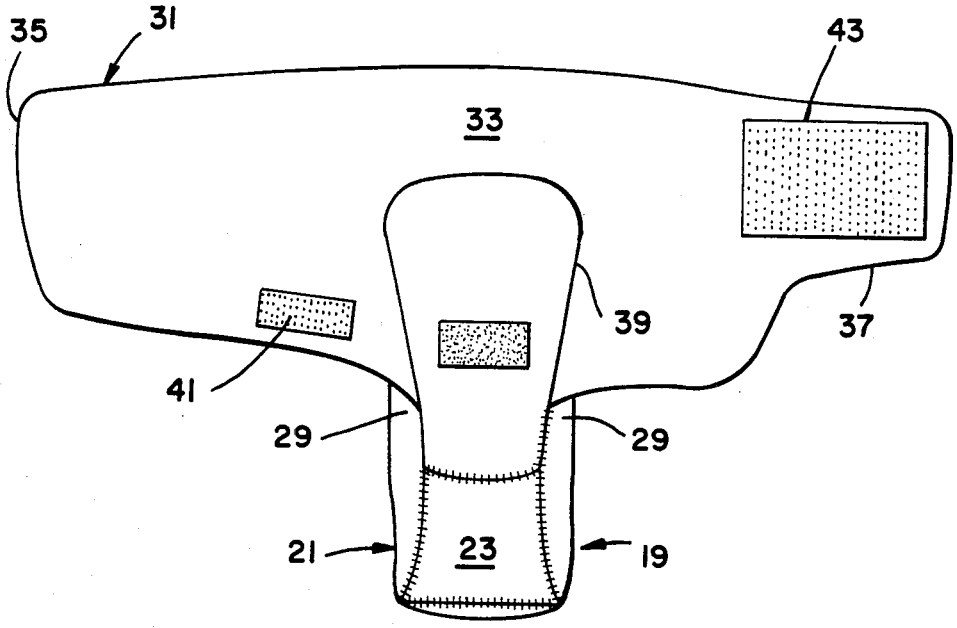
FIG. 2 is a view of FIG. 1 showing the closable open front of the boot.

In FIGS. 1–4, the wet suit boot of the present invention, generally designated 19, is shown having a foot enclosing portion generally designated 21 including toe covering 23, sole 25, back 27 and ankle 29. An ankle enclosing portion, generally designated 31, having a central segment 33, is attached at back 27 and ankle 29 of foot enclosing portion 21. Ankle enclosing portion 31 further includes medial flap 35, extending from one side of central segment 33, and lateral flap 37, extending from the opposite side of central segment 33, to form a closable open front to the boot, as best seen in FIG. 2. Boot 19 also includes tongue 39, attached to and extending generally from foot-enclosing portion 21 toward central segment 33. The medial flap and the lateral flap are held in their closed positions by releasable fasteing means, preferably of the hook and loop type commonly avalable under the name VELCRO.

The first fastening means is a first pair of mating fastener elements 41, as shown in FIG. 2, one of elements 41 being mounted on the exterior surface of tongue 39 and the other being mounted on the interior surface of medial flap 25 for releasably fastening medial flap 25 to tongue 39.

Figure 4:
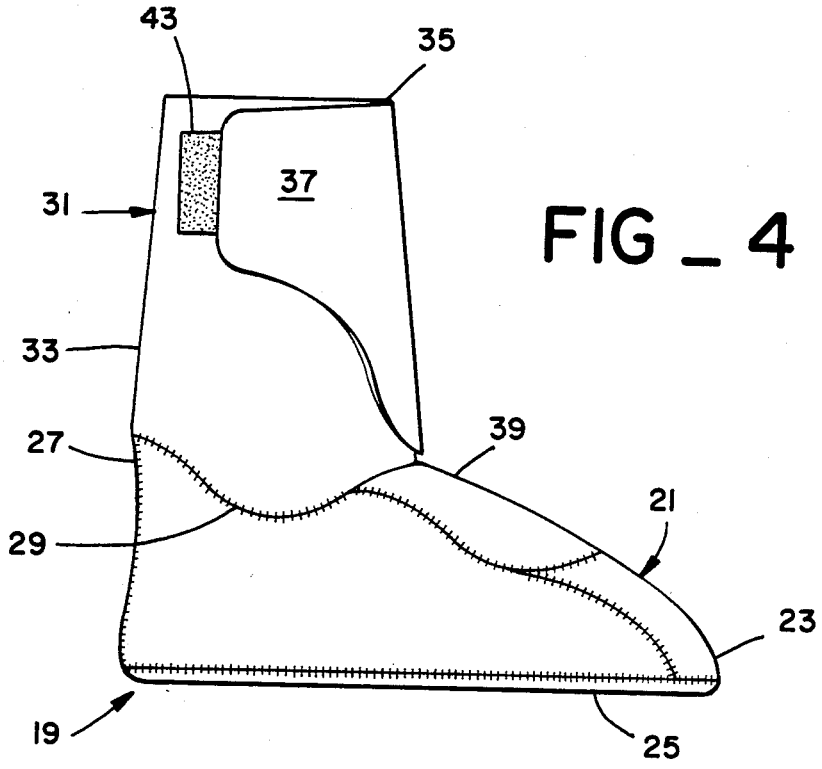
FIG. 4 is a side elevation view of the other side of the boot.

The second fastening means is also a pair of mating fastener elements 43, one of elements 43 being mounted on the exterior surface of medial flap 35 and the other being mounted on the interior surface of lateral flap 37 for releasably fastening of lateral flap 37 to medial flap 35, as best seen in FIGS. 2 and 4.

Figure 5:
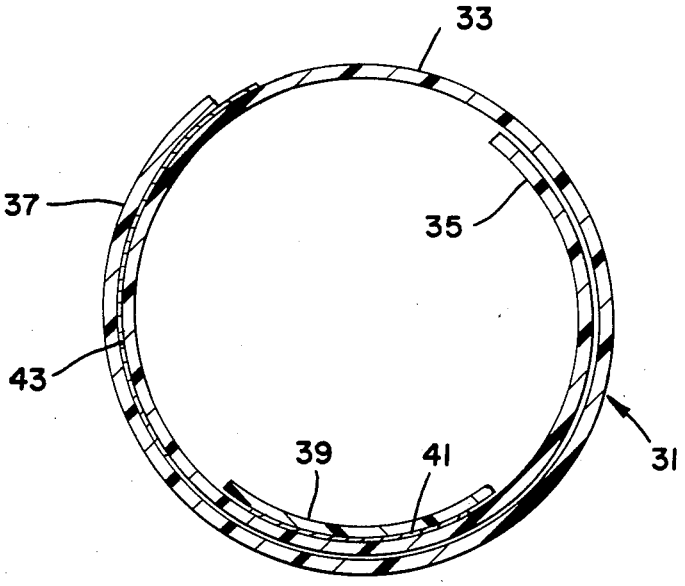
FIG. 5 is a cross section view taken along the section line 5—5 of FIG. 1.

When fastener elements 41 and 43 are mating hook and loop fasteners they provide a large and secure surface area for fastening and do not rust or corrode in water. Hook and loop fasteners also can fasten in different positions so that the position and tightness of the fit can be adjusted. As shown in FIG. 5, this construction provides substantially two overlapping layers of elastomer around the lower calf that can tightly embrace the user's calf to achieve the desired result. Additionally, foot-enclosing portion 21, ankle enclosing portion 31 and tongue 39 are preferably formed from flexible, closed-cell foam elastomer which provides the thermal insulating potential described above. Although the two fastener elements disclosed will function effectively to fasten and maintain the flaps around the lower calf and achieve the desired tight fit, it is understood that additional fastener elements may be provided.

To use the boot the user first releases all fasteners, spreads the flaps and inserts a foot into foot enclosing portion 21. The user then pulls tongue 39 upward to cover the front of the ankle. The user then wraps medial flap 35 tightly around the front of the ankle to overlap tongue 39 and tightly fastens first pair of mating fastener elements 41 together, and finally, the user wraps lateral flap 37 tightly around the front of the ankle to overlap tongue 39 and medial flap 35 and tightly fastens second pair of mating fastener elements 43 together to provide the secure, water-circulation inhibiting boot of the present invention. Easy removal is achieved by the reverse of the above process. Removal of fasteners such as zippers or laces is particularly difficult when they are wet and when the user's hands are cold and tried. The boots of this invention are very easy to remove even under difficult conditions because the fasteners simply pull apart and because the boot opens widely so that a user's foot can be removed with substantially nothing binding against it.

The invention claimed is:

1. A wet suit boot comprising:

a foot-enclosing portion;

an ankle enclosing portion having a central segment attached at the back and ankle of said foot-enclosing portion, a medial flap extending from one side of said segment and a lateral flap extending from the opposite side of said segment to form a closable open front to said boot;

a tongue, attached to and extending generally from said foot enclosing portion toward said central segment;

first fastening means formed and positioned to overlap and releasably and adjustably fasten said medial flap to said tongue; and second fastening means formed and positioned to overlap and releasably and adjustably fasten said lateral flap to said medial flap.

2. The boot defined in claim 1 wherein, said first fastening means is a first pair of mating fastener elements, one of said first pair being mounted on the exterior surface of said tongue and the other of said first pair being mounted on the interior surface of said medial flap for releasably fastening of said medial flap to said tongue; and said second fastening means is a second pair of fastener elements, one of said second pair being mounted on the exterior surface of said medial flap and the other of said second pair being mounted on the interior surface of said lateral flap for releasably fastening of said lateral flap to said medial flap.

3. The boot as defined in claim 2 wherein, said first pair and said second pair are mating hook and loop fasteners.

4. The boot defined in claim 1 wherein, said foot enclosing portion, said ankle enclosing portion and said tongue are formed from flexible, closed-cell foam elastomer.

* * * * *